United States Patent [19]

Williams

[11] 4,369,680

[45] Jan. 25, 1983

[54] METHOD AND APPARATUS FOR CHANGING SLICER CUTTING PARAMETERS IN A ROTARY FOOD PROCESSOR

[75] Inventor: James E. Williams, Stamford, Conn.

[73] Assignee: Cuisinarts Research & Development Inc., Greenwich, Conn.

[21] Appl. No.: 210,272

[22] Filed: Nov. 26, 1980

[51] Int. Cl.[3] ..... B26D 7/00

[52] U.S. Cl. ..... 83/13; 83/355; 83/356.3; 83/592; 83/701; 241/92

[58] Field of Search ..... 241/37.5, 92, 273.2; 83/395, 355, 356.3, 467, 468, 592, 13, 701

[56] References Cited

U.S. PATENT DOCUMENTS

| | | | |
|---|---|---|---|
| 2,084,924 | 6/1937 | Staats | 83/592 X |
| 3,137,333 | 6/1964 | Nishina | 241/273.2 |
| 3,542,302 | 11/1970 | Salzmann, Jr. | 241/92 X |
| 3,892,365 | 7/1975 | Verdon | 241/92 |
| 3,985,304 | 10/1976 | Sontheimer | 241/92 |
| 4,127,342 | 11/1978 | Coggiola | 403/243 |
| 4,198,887 | 4/1980 | Williams, Jr. | 83/356.3 |
| 4,200,244 | 4/1980 | Sontheimer | 241/282.1 |
| 4,213,570 | 7/1980 | Jones | 241/38 |
| 4,216,917 | 8/1980 | Clare et al. | 241/37.5 |
| 4,226,373 | 10/1980 | Williams | 241/37.5 |
| 4,227,655 | 10/1980 | Williams | 241/92 |

*Primary Examiner*—James M. Meister

*Attorney, Agent, or Firm*—Parmelee, Bollinger & Bramblett

[57] ABSTRACT

A rotary slicing tool for a food processor has a horizontal disc-like member with an opening therein and a cutting blade positioned at an elevated location above the opening relative to the horizontal top surface of the disc-like member providing a cut having a thickness determined by the vertical elevation between the cutting blade and the horizontal top surface. A removable cover disc having the same general configuration and proportion as the disc-like member is mounted on the cutting member for changing the thickness of the slices as determined by the thickness of the cover disc. The cut of the rotary slicing tool may therefore be varied by using removable and replaceable cover discs of different thicknesses without necessitating the complete removal and replacement of the rotary tool in the food processor. Certain cover discs may include auxiliary blades for converting the slicing tool into a French fry slicer or Julienne slicer.

21 Claims, 13 Drawing Figures

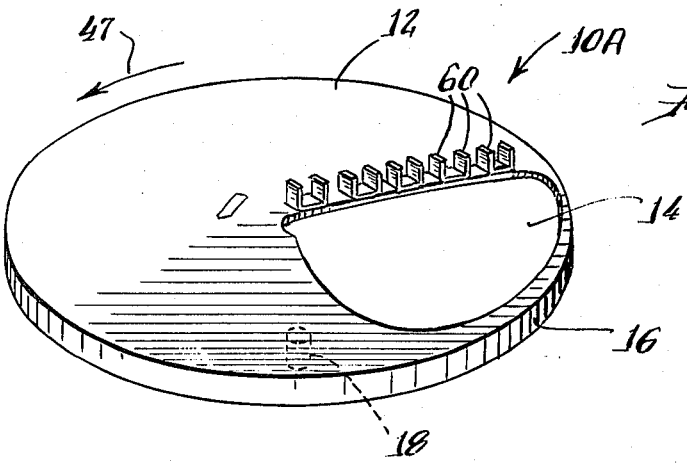
Fig. 10.
Fig. 6.
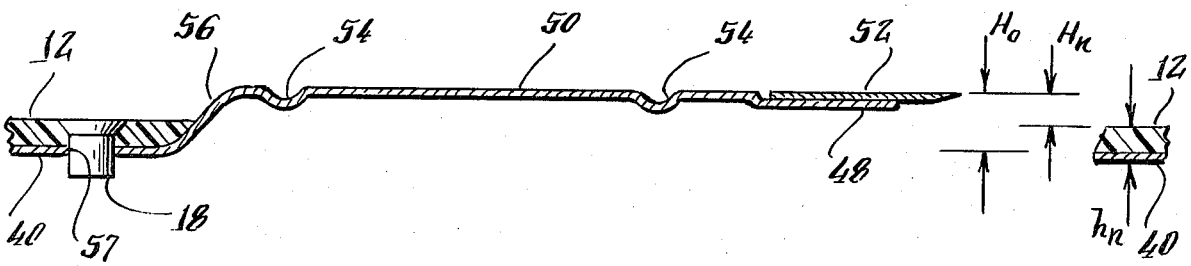
Fig. 7.
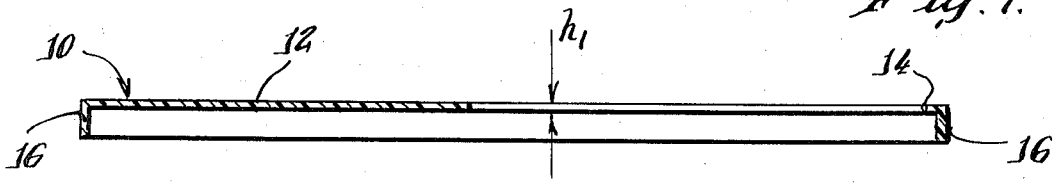
Fig. 8.
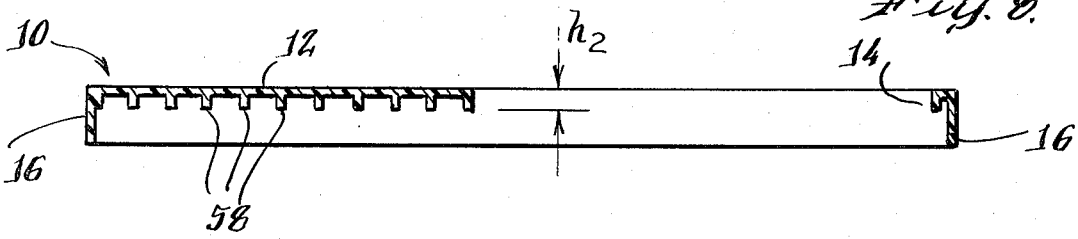
Fig. 9.
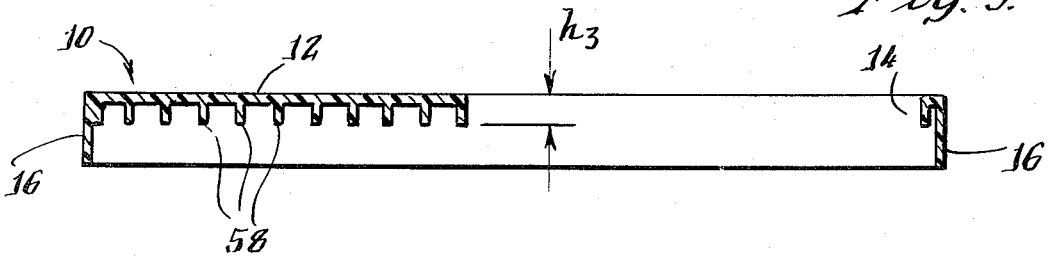

METHOD AND APPARATUS FOR CHANGING SLICER CUTTING PARAMETERS IN A ROTARY FOOD PROCESSOR

BACKGROUND OF THE INVENTION

This invention relates to rotary food processing tools for food processors, and more particularly, to such rotary food cutting tools where the parameters and functions of the cut may be varied by positioning removable and interchangeable cover discs on the tool for changing the parameters and the functioning thereof without the necessity of removing and replacing the entire tool in the food processor.

The present invention is applicable to food processors of the type having a working bowl with a motor driven tool drive means projecting upwards into the bowl with which various selected rotary food processing tools can be engaged to be driven for performing various food processing operations in accordance with the desires of the user. A removable cover is secured over the top of the bowl during use. The cover includes a feed tube having a feed passageway which opens downwardly through the cover into the top of the bowl and food items to be processed are placed in the feed tube and then are pushed down through the feed tube down into the bowl by means of a removable food pusher which is adapted to slide down in the manner of a plunger through the feed tube. The food items are sliced or otherwise processed by the rotating food processing tool in the top of the bowl.

Additional information with respect to such food processors may be had by reference to U.S. Pat. Nos. 3,892,365—Verdun; 3,985,304—Sontheimer; 4,198,887—Williams; 4,200,244—Sontheimer; 4,216,917—Clare and Sontheimer; 4,213,570—Jones; 4,226,373—Williams; and 4,227,655—Williams.

Of particular interest to the present invention are the rotary cutting tools which are used for slicing, dicing, cutting, and the like of food items such as potatoes, onions, carrots, cucumbers, celery, cabbage, squash, etc. Such rotary cutting tools have a horizontal disc-like member formed of sheet metal, preferably of stainless steel, which is mounted on an elongated hub extending down in the bowl of the food processor and which is coupled near the lower end to a motor-driven tool drive means in the food processor. A horizontal cutting blade is mounted in an elevated location above an opening in the horizontal disc-like member. The thickness of the cut produced by such a cutting tool is determined by the distance between the elevation of the cutting edge of the cutting blade and the elevation of the top surface of the disc-like member.

In the prior art, in order to change the parameters or the particular cutting function of such a rotary food processing tool the entire tool is removed from the bowl and is replaced by another tool. In other words, to change the cutting function even with respect to the thickness of the slices, the prior art requires that the entire tool must be removed from the motor drive and a new tool be engaged therewith. Accordingly, a multiplicity of separate tools must be on hand for the user, even when the same type of tool is used but the function is changed slightly, for example, for performing a slicing operation in which the food is sliced thicker or thinner. Aside from the expense of providing all of the tools, all of these tools must be stored in the kitchen. In crowded kitchens with little storage space, the need for having on hand a multiplicity of individual tools can cause the user a difficult storage problem.

SUMMARY OF THE INVENTION

Accordingly, it is an object of this invention to provide a new and improved rotary food cutting tool in which the parameters and functioning of such tools may be varied without removing and replacing or changing the tool itself.

A further object of this invention is to provide a new and improved rotary food cutting tool which may provide a plurality of cutting functions by merely mounting removable disc-like covers thereon without otherwise changing or replacing the tool itself.

Still another object of this invention is to provide a new and improved rotary food cutting tool with a plurality of removable cover discs which are easily positioned on the rotary tool without removing the tool itself from the food processor, thereby varying the parameters or functioning of the rotary tool.

Still a further object of this invention is to provide a new and improved rotary food cutting tool assembly for a food processor which enables a fewer number of rotary food processing tools themselves to be used for performing the same plurality of food processing operations as in the prior art. Among the many advantages of the present invention are those resulting from the fact that it enables a single slicing tool to be readily converted for cutting different thicknesses of slices and for cutting French fry or Julienne strips by engaging various removable cover discs on top of the tool.

In carrying out this invention in one illustrative embodiment thereof, a rotary food cutting tool is provided for use in a rotary food processor of the type having an upright working bowl for enclosing the rotary food cutting tool and motor-driven tool drive means for rotating the tool within the bowl and a removable cover adapted to be secured on the bowl having a feed tube mounted thereon for feeding food items to the rotary cutting tool within the bowl. The rotary food cutting tool has an elongated hub with a horizontal disc-like member secured to the head of the hub for rotation therewith and with the lower portion of the elongated hub being engageable with the tool drive means to be rotated thereby. The disc-like member has an opening therein, and an elevated cutting blade positioned above the opening on the horizontal disc-like member such that food items cut by the blade pass down through the opening into the bowl. A cover disc having the same general configuration as the disc-like member is adapted to be mounted on top of the disc-like member and to be coupled to the disc-like member for rotation with said member.

This cover includes a mounting means for removably mounting the cover on the disc-like member which enables the cover to be quickly and conveniently removed from the rotating tool and also couples the cover disc to the cutting tool for causing the cover to rotate with the cutting tool. This cover includes an opening which generally surrounds the elevated cutting means when the cover is mounted on the disc-like cutting means. The cover disc has a predetermined thickness which determines the thickness of the cut slices. The cut thickness is equal to the difference in elevation between the cutting means and the top surface of the cover disc when the cover is mounted on the disc-like member. Accordingly, the thickness of the cut made by the cutting tool may be varied by changing the cover disc to a cover having a different thickness mounted on the disc-like member without requiring the removal and the replacement of the entire tool from the machine.

In other words, the thickness of slices made by a bare tool is reduced by the thickness of the cover disc. Therefore, removing the cover disc and replacing it by a thicker one reduces the slicing thickness, and vice versa. When no cover disc is utilized, the rotary slicing tool cuts relatively thick slices.

In addition, some of the removable covers may include secondary or auxiliary cutting blades for changing the action of the slicing tool for enabling such a tool to be converted into a French fry or a Julienne slicer. The placement, size and spacing of the secondary or auxiliary blades on the cover discs may also be different so that different sizes of Julienne strips or French fries or other cutting and slicing functions may be achieved utilizing these removable cover discs.

Since the cover discs are flat and considerably smaller than a whole rotary cutting tool, which has an elongated hub, the cover discs take up considerably less space, for example when stored in a kitchen drawer, and are easier to store in a stack on top of one another, as well as being considerably less expensive, rather than providing a separate rotary food processing tool for each operation which is to be performed.

BRIEF DESCRIPTION OF THE DRAWINGS

The invention together with further aspects, objects, features and advantages thereof will be more clearly understood from a consideration of the following description taken in conjunction with the accompanying drawings, in which:

FIG. 6 is an enlarged cross-sectional view illustrating a cover disc of predetermined thickness mounted on a rotary slicing tool.

FIGS. 7, 8 and 9 are cross-sectional views of cover discs having different cross-sectional thicknesses as illustrated in FIGS. 2, 4 and 5, respectively.

FIG. 10 is a perspective view of a removable cover disc having auxiliary cutting blades positioned thereon for changing the action of the rotary slicing tool, for example for cutting French fry strips.

DESCRIPTION OF THE PREFERRED EMBODIMENTS

Figure 1:
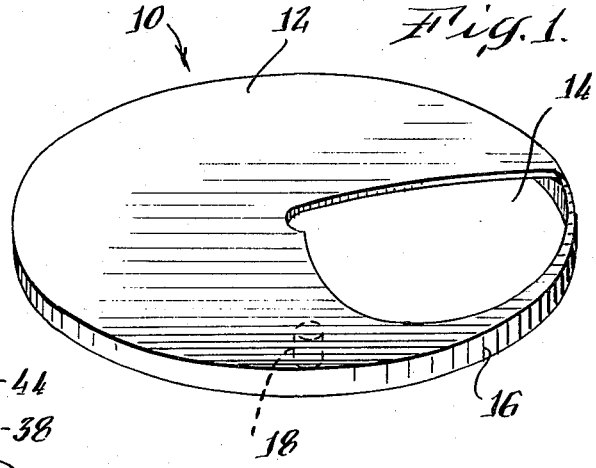
FIG. 1 is a perspective view illustrating one form of a removable cover disc in accordance with the present invention.

Referring now to FIG. 1, a removable cover or lid disc, referred to generally with the reference numeral 10, has a circular flat upper surface 12 with an opening 14 therethrough and a downturned flange 16 extending around the perimeter of the circular flat surface 12. A positioning and coupling element 18 is secured to the cover disc 10 and projects downwardly behind the opening 14. This element 18 serves for positioning and aligning the cover disc 10 in proper position on a rotary processing tool. The cover disc 10 is slightly larger and has the same general configuration as the horizontal disc-like member of a rotary processing tool of a food processor, such that this cover disc 10 is adapted to be positioned on and directly over the conventional food processing tool. The opening 14 corresponds with the opening in the horizontal disc-like member of the rotary tool as will be explained hereinafter. The cover 10 is preferably of a plastic having good lubricity for sliding beneath the food item being sliced, for example such as Teflon material, PTFE plastic, nylon, Delrin material, polycarbonate, acrylic plastic, etc., because the circular flat top surface 12 of the cover disc 10 overlies the rotary food processing tool. Thus, the cover disc 10 contacts the food as it is being sliced. In addition, certain metal parts may be secured to the cover disc 10 as a component part of this cover disc for modifying or varying the cutting functions as will be explained below.

Figure 2:
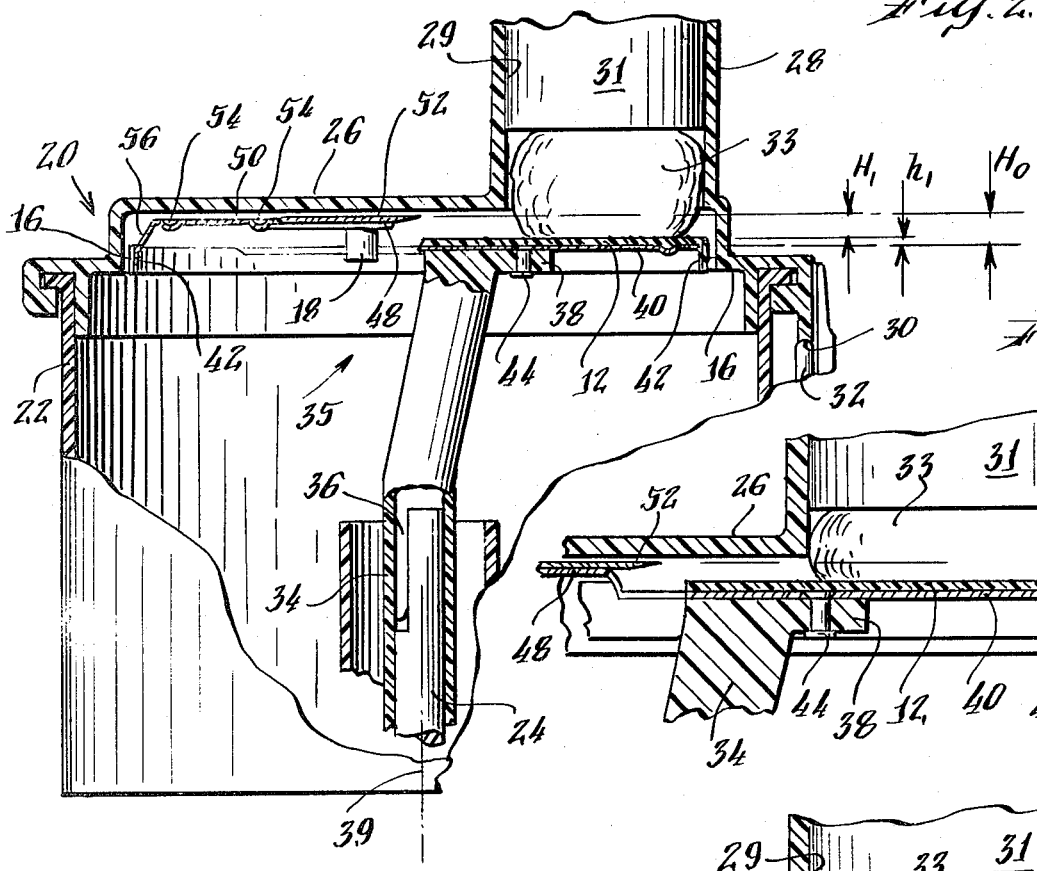
FIG. 2 is a cross-sectional view of the top portion of the bowl and cover of a food processor having the cover disc of FIG. 1 mounted on a rotary slicing tool.

As shown in FIG. 2, the cover disc 10 is utilized in a food processor, indicated generally with the reference number 20, which includes an upright working bowl 22 with motor-driven tool drive means 24 in the form of a shaft extending up into the bowl. A removable cover 26 having a feed tube 28 extending through the cover closes the bowl 22. At the same time, cam surface 30 on the cover depresses an actuator rod 32 which closes a switch to energize a motor (not shown) for driving the tool shaft 24. The feed tube 26 provides a feed passageway 29 for introducing food to be processed into the working bowl 22. A removable pusher 31 is adopted to slide down into the feed tube 28 for pushing a food item 33 against the rotary processing tool.

The rotary food processing tool, referred to generally with the reference number 35, is positioned near the cover 26 and has an elongated hub 34 thereon with a coupling means 36, for example such as a key or spline, on the lower end of the elongated hub which is coupled to the motor-driven tool drive means 24 for rotating the tool 35. The upper end of the elongated hub 34 has a hub head 38 thereon which carries a disc-like member 40 of stainless steel having a depending peripheral skirt 42. The disc-like member 40 is secured by rivets 44 to the hub head 38 and accordingly is driven by the shaft 24 when the coupling means 36 on the lower end of the elongated hub 34 is engaged with the tool drive shaft 24 of the food processor 20. As illustrated in FIG. 2 the hub head 38 is offset from the axis of rotation 39 of the tool which is a preferred form of tool for reasons as described in my U.S. Pat. No. 4,227,655, mentioned above. The present invention, however, is not limited to the offset hub but would also be applicable to tools with a hub which is aligned with the axis of rotation 39 of the tool drive shaft 24 of the food processor 20.

Figure 3:
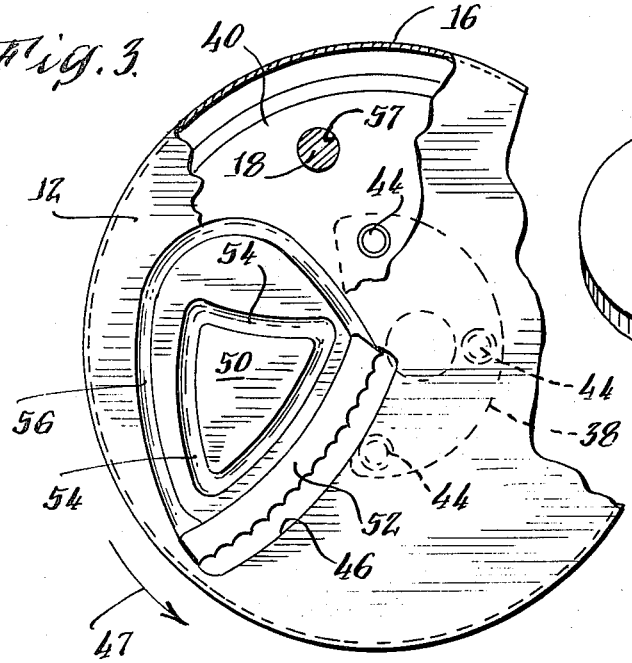
FIG. 3 is a top view of the rotary slicing tool and cover disc of FIG. 2, partly broken away in section.

The rotary food processing tool 35 is a rotary slicing implement. As will be seen in FIG. 3, the disc-like member 40 has an opening 46 formed in the horizontal surface of the disc. This opening 46 extends from a region near the hub head 38 out toward the depending peripheral skirt 42 on the disc-like member 40. The tool 35 rotates in a counter clockwise direction as shown by the arrow 47. The region behind the opening 46 is pressed upwardly to form an elevated lip 48 on an elevated platform 50. On this lip 48 at the front of the platform 50 there is secured an arcuate hardened steel slicing blade 52 which is fastened in place by spot welding. The slicing blade 52, which is illustrated as having a slightly scalloped or serrated cutting edge, as seen in FIG. 3, projects forwardly partially over and above the arcuate opening 46. The elevated platform 50 has downwardly embossed strengthening ribs 54 and a gradually downwardly sloping rear shoulder 56 extending around behind the elevated platform 50. The configuration of the platform 50 is to facilitate the slicing of the food item being processed by the food processor 20. As the items are sliced they will pass through the slot 46 into the bowl 22 with as little interference as possible from the sloping shoulder 56 of the platform.

The thickness of the cut provided by the bare tool 35 is the vertical distance between the elevation of the cutting edge of the blade 52 and the elevation of the top surface of the horizontal disc-like member 40, and is designated in FIG. 2 by the reference $H_o$. In accordance with the present invention, a cover disc or lid 10 is slipped over the rotary cutting tool 35, with the downturned flange 16 of the cover disc 10 in snug engagement with and overlying the depending peripheral skirt 42 of the horizontal disc-like member 40 of the rotary slicing tool 35. In addition, the positioning and coupling element 18, in the form of a downwardly projecting stud, on the cover disc 10 engages into a socket 57 in the horizontal disc-like member 40 of the rotary tool 35. This interengaged coupling means 18 and 57 prevents any relative movement between the cover disc 10 and the rotary tool 35. Furthermore, the opening 14 in the cover disc 10 is shaped to conform with and to surround the slot 46 in the tool 35 and has a configuration conforming to the shape of the gradually sloping shoulder 56 of the elevated platform 50 on the rotary cutting tool 35 (see FIG. 6). Accordingly, three cooperating means stabilize and align the positioning of the cover disc 10 on the rotary tool 35. These cooperating means include: (1) the frictional engagement between the closely fitting downturned flange 16 encircling the depending peripheral skirt 42, (2) the engagement of the stud 18 in cooperation with the socket 57 or hole in the disc-like member 40 of the cutting tool 35, and (3) the configuration of the opening 14 which conforms with and is complementary to and closely fits around the gradually sloping shoulder 56 of the elevated platform 50.

The purpose of the cover disc 10 is to alter the cutting function of the rotary tool 34 by changing the thickness of the food slices produced in cutting a food item 33, as shown by the following equation:

$$H_n = H_o - h_n \quad (1)$$

where $H_o$ is the initial difference in elevation between the cutting edge of the blade 52 and the bare upper surface of the flat horizontal disc-like member 40 of the rotary tool. The thickness, in general, of any cover disc 10 is $h_n$, and the resultant thickness of the cut pieces is $H_n$.

Reference is made to FIG. 6 which illustrates the above relationship as well as showing in an enlarged view, a cover disc 10 mounted on the disc-like member 40 of a rotary cutting tool 35, with the opening 14 in the disc 10 conforming to the exterior lower portion of the gradually downwardly sloping shoulder 56 of the elevated platform 50. As shown, when a particular cover disc 10 is mounted upon the horizontal disc-like member 40, the particular thickness $h_n$ of this cover disc is subtracted from $H_o$ leaving a new cut thickness of $H_n$. Accordingly, the thickness of the cut has been changed from $H_o$ to $H_n$ quickly and conveniently by mounting the cover disc 10 upon the rotary slicing tool 35.

This mounted relationship is also illustrated in a less enlarged form in FIG. 2 showing the entire cover disc 10 mounted upon the rotary tool 35.

As is illustrated in FIGS. 7, 8 and 9 different effective vertical thicknesses $h_1$, $h_2$ and $h_3$, respectively, are shown for the disc 10. In FIG. 7 a thin deck layer corresponds to the illustrated example $h_1$ in FIGS. 1 and 2.

In FIG. 8 an effectively thicker cover disc 10 is illustrated having a thickness $h_2$. This effectively thicker cover disc 10 is provided by forming the under surface of the horizontal deck layer 12 with a plurality of concentric ridges 58 which serve to elevate the layer 12 somewhat above the horizontal disc-like member 40. When the cover disc of FIG. 8 is placed upon the rotary tool as shown in FIG. 4, then slices of thickness $H_2$ are produced.

In FIG. 9 even a thicker cover layer $h_3$ is illustrated. When the cover illustrated in FIG. 9 is placed upon the rotary tool 35, as shown in FIG. 5, it causes a considerably thinner slice $H_3$ to be produced as shown in FIG. 5.

As is illustrated in FIGS. 8 and 9 the disc-like member 40 need not be completely solid to obtain the different thicknesses but may be provided with concentric, circular, radially spaced ridges or ribs 58 of the desired height. This ridged type of construction saves on material and provides a lighter cover disc 10 making it easier for the motor drive to smoothly rotate the compound rotary tool 35 plus cover disc 10.

Figure 4:
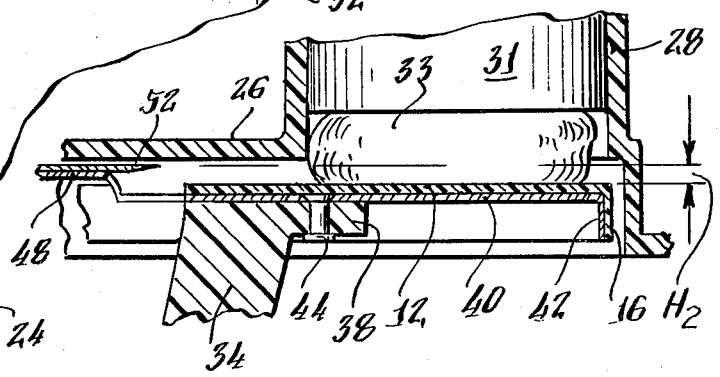
FIG. 4 is a partial cross-sectional view similar to FIG. 2 showing a thicker cover disc for producing a thinner slice than with the rotary tool plus cover illustrated in FIG. 2.
Figure 5:
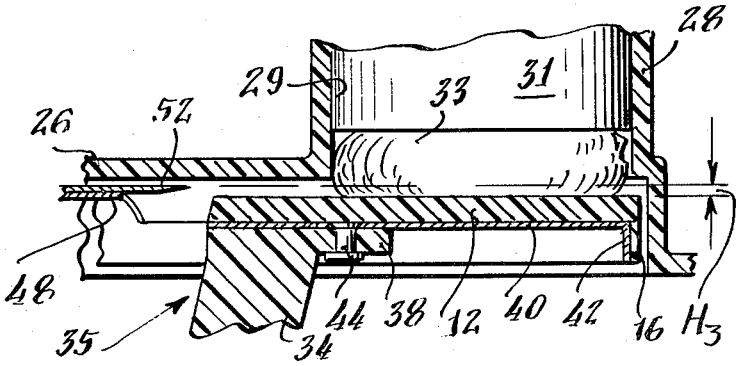
FIG. 5 is similar to the cross-sectional view of FIG. 4 showing the use of a cover disc which is even thicker for producing even thinner slices from the same rotary tool as in FIGS. 2 and 4.

FIGS. 4 and 5 illustrate disc 40 with different thicknesses to illustrate the change in slicing thickness which may be provided. In FIG. 2 the disc thickness 40 is the least and accordingly the slice thickness $H_1$ provided by the food processor is thicker. While in FIG. 4 the thickness of the disc cover 10 is of intermediate thickness, providing an intermediate slice thickness $H_2$. In FIG. 5 a rather thick cover disc 10 provides the thinnest slice $H_3$.

Figure 11:
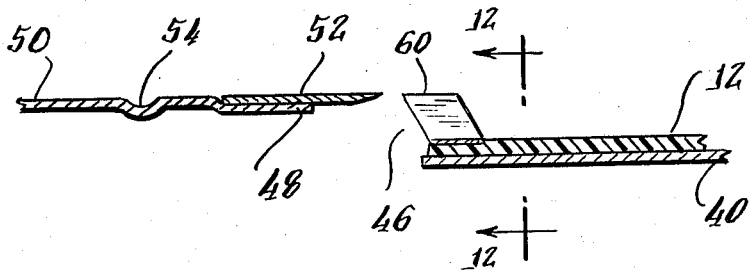
FIG. 11 is a cross-sectional view of the cover disc of FIG. 10 shown mounted on a rotary slicing tool.
Figure 12:
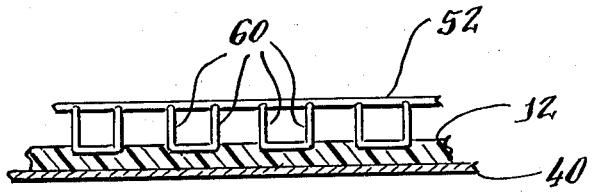
FIG. 12 is a partial cross-sectional view taken in front of the auxiliary cutting blades of a removable cover disc positioned on a rotary slicing tool.
Figure 13:
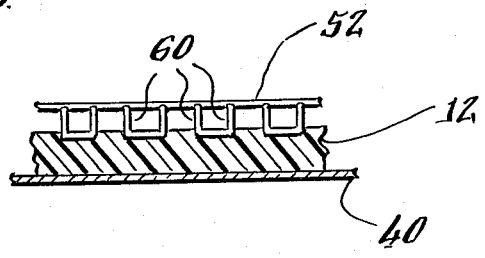
FIG. 13 is a partial cross-sectional view similar to FIG. 12 taken in front of the auxiliary cutting blades of a removable cover disc similar to FIG. 12 mounted on a rotary slicing tool in which the thickness of the cover and the spacing of the auxiliary blades have been changed in order to provide smaller sized sliced strips.

FIG. 10 illustrates another form of cover disc 10A in which additional cutting elements in the form of secondary or auxiliary cutting blades 60 are incorporated for changing the action of the rotary slicing tool 35, thereby enabling the tool to be converted into a French fry slicer. The secondary or auxiliary blades 60 are preferably made of stainless steel and are secured to the cover disc 10 so that these auxiliary blades project upwardly immediately in front of the opening 14 as indicated by the direction of rotation 47. As shown in FIG. 11, the auxiliary blades 60, when the cover disc 10 is mounted on the rotary tool 35, extend upright above the arcuate slot 46 with the main blade 52 overlying and elevated above the slot 46. Accordingly, depending upon the configuration of the auxiliary blades 60, the slicing function has been altered to provide a dicing of French fry cutting action. As shown in FIGS. 12 and 13, by changing the size and spacing of the secondary or auxiliary blades 60 and also by changing the effective thickness of the cover disc 10 various sizes of dicing cutting can be produced. Larger dicing is shown in FIG. 12 while smaller dicing such as for Julienne strips, is shown in FIG. 13. A number of modifications will be apparent from these structures to provide different shapes and thicknesses of dices, strips or cuts.

The present invention offers the very real benefit of greatly expanding the cutting functions of the food processor without providing a larger number of bulky (and rather difficult to store) rotary slicing tools. The removable cover discs are capable of changing the parameters and the functioning of a rotary slicer tool in a very simple and inexpensive manner. Furthermore, a reasonable number of these cover discs may be easily stored. They provide an expanded use for the food processor without employing an unwieldy number of the more expensive rotary cutting tools. By virtue of being able to use removable and interchangeable cover discs, the user is enabled to perform the equivalent functions of several slicing tools by using only one rotary cutting tool itself plus a selected cover disc. This cooperative interaction of cover disc plus rotary tool conserves storage space and is less expensive than providing a plurality of tools. Further, the use of the removable cover discs which may include secondary cutting blades enables the user to convert a slicing tool into a different type of slicer or dicer.

Since other changes and modifications varied to fit particular operating requirements and environments will be apparent to those skilled in the art, the invention is not considered limited to the examples chosen for purposes of illustration, and covers all equivalent changes and modifications which do not constitute a departure from the true spirit and scope of this invention.

What is claimed is:

1. In a food processor of the type including a housing having an electric motor drive, a bowl mountable on said housing for enclosing a rotary food processing tool within said bowl, said tool being rotatable within said bowl by said electric motor drive, a removable cover adapted to be secured in a position on said bowl, a feed tube forming a passageway for feeding food items into said bowl, said food processing tool having an elongated hub with a head on one end thereof and a coupling means on the other end thereof adapted to be coupled to and rotated by said electric motor drive, and a horizontal disc-like member mounted on said hub head having an opening therethrough and cutting means positioned above said opening at an elevated location relative to said disc-like member, the thickness of the cut pieces produced by said cutting means being determined by the difference in elevation between said cutting means and the top surface of said disc-like member, the improvement comprising:

a cover disc having the same general configuration as said horizontal disc-like member with an opening in said cover disc, said cover disc being adapted to be fitted in mounted relationship on top of said horizontal disc-like member of the rotary tool by having an under surface of said cover disc remain in continuous contact with the upper surface of said disc-like member, with said opening in said cover disc being in registration with said opening in said horizontal disc-like member, for changing the effective thickness of said disc-like member by providing a new elevated upper surface for said disc-like member, when said cover disc is mounted on said disc-like member, and positioning means on said cover disc engageable with said horizontal disc-like member when said cover disc is fitted in mounted relationship on top of said horizontal disc-like member for preventing relative movement between said cover disc and said disc-like member, whereby said cover disc is caused to rotate together with said tool, by virtue of which the thickness of the cut pieces produced by said cutting means becomes reduced to be equal to the difference in elevation between said cutting means and the top of said cover disc.

2. In a food processor as set forth in claim 1 wherein said cutting means comprises a slicing blade mounted on the rim of an elevated platform on said horizontal disc-like member and said elevated platform has a gradually sloping shoulder, the improvement in which:

said opening in said cover disc conforms with the configuration of said elevated platform plus said opening and is nestled down around said gradually sloping shoulder when said cover disc is fitted on the horizontal disc-like member food processing tool and with the opening in said disc-like member being uncovered.

3. In a food processor, the improvement as set forth in claim 1 or 2 in which:

said cover disc includes a single layer of material.

4. In a food processor, the improvement as set forth in claim 1 or 2 in which:

the top surface of said cover disc is provided by a layer of material, said layer having circular concentric reinforcing ribs projecting down from the underside thereof which contribute to the effective overall thickness of said cover disc.

5. In a food processor, the improvement as set forth in claim 1 or 2, in which:

said horizontal disc-like member has a socket therein, and said positioning means is a lug projecting down from said cover disc for engaging into said socket for preventing said cover disc from turning relative to said disc-like member.

6. In a food processor, the improvement as set forth in claim 2, in which:

said horizontal disc-like member has a socket therein located closely behind said sloping shoulder of said elevated platform, and said positioning means is a lug projecting down from said cover disc for engaging into said socket for preventing said cover disc from turning relative to said disc-like member.

7. A rotary food cutting tool for use in a rotary food processor of the type having an upright working bowl for enclosing the rotary food cutting tool and motor drive means for rotating the tool within said bowl and a removable cover adapted to be secured on said bowl and a feed tube for feeding food items to said rotary cutting tool in said bowl, said novel rotary food cutting tool comprising:

an elongated hub having an upper head and a lower drive coupling portion adapted to be coupled to and rotated by said motor drive means, said upper head of said hub having a horizontal disc-like member secured thereto for rotation therewith, said disc-like member having an opening therein and an elevated cutting means positioned at an elevation above said opening in said horizontal disc-like member, a cover disc adapted to be mounted for rotation with said disc-like member, mounting means on said cover disc for removably mounting said cover disc on said disc-like member with an undersurface of said cover-disc being in continuous contact and flush with an upper surface of said disc-like member when said cover disc is mounted thereon, an opening in said cover disc which generally surrounds said elevated cutting means and said opening in said disc-like member when said cover disc is mounted on said disc-like member, and said cover disc having a predetermined thickness which when mounted on said disc-like member changes the effective thickness of said disc-like member and determines the thickness of the cut pieces produced by said cutting means, said thickness being the difference in elevation between said cutting means and the top surface of said cover disc when mounted on said disc-like member, whereby the thickness of cut pieces produced by said tool may be varied by changing the cover disc mounted on said disc-like member without requiring the removal and replacment of the entire tool in said bowl.

8. The rotary food cutting tool as claimed in claim 7 in which:

said cutting means comprises a slicing blade mounted on the rim of an elevated platform, said elevated platform having a gradually sloping rear shoulder, and said cover-disc conforms with the configuration of said platform and its gradually sloping shoulder plus the opening in said disc-like member for enabling the opening in said cover disc to nestle around said platform and its shoulder with said opening in the disc-like member remaining uncovered when said cover disc is mounted on said rotary food cutting tool.

9. The rotary food cutting tool as claimed in claim 7 or 8 in which:

said predetermined thickness of said cover disc is solid.

10. The rotary food cutting tool as claimed in claim 7 or 8 in which:

said cover disc has circular concentric reinforcing ribs on the underside thereof which rest upon said horizontal disc-like member of the rotary cutting tool when said cover disc is mounted thereon and which form a portion of the thickness of said cover disc.

11. The rotary food cutting tool as claimed in claim 7 or 8, in which:

said mounting means includes a recess in said tool and a downwardly projecting element on said cover disc for engaging in said recess for preventing said cover disc from turning relative to said tool.

12. A method for changing the thickness of cut pieces produced by a rotary food processing tool in a food processor of the type including a housing having an electric motor drive, a bowl mountable on said housing for enclosing a rotary food processing tool within said bowl, said tool being rotatable within said bowl by said electric motor drive, a removable cover adapted to be secured in position on said bowl, a feed tube forming a passageway for feeding food items into said bowl, said food processing tool having an elongated hub with a head on one end thereof and a coupling me1ns on the other end thereof adapted to be coupled to and rotated by said electric motor drive, and a horizontal disc-like member secured to said hub head and having an opening therethrough with slicing means positioned at an elevated location relative to said disc-like member, said slicing means being located near said opening for allowing the cut pieces of food items to pass down through said opening, the thickness of the cut pieces produced being determined by the difference in elevation between said slicing means and the top of said disc-like member, said method comprising the steps of:

selecting a cover disc of predetermined thickness, fitting said cover disc of predetermined thickness in mounted relationship over said disc-like member with the cover disc remaining in continuous contact with the upper surface of the disc-like member for changing the elevation between said slicing means and the top of said disc-like member, and engaging said cover disc with said tool for causing said cover disc to rotate with said tool for defining a smaller difference in elevation between the slicing means and the top surface of said cover disc, whereby the cut pieces are now equal to said smaller difference in elevation.

13. A novel cover disc for use in the bowl of a food processor with a rotary tool of the type having a horizontal disc-like member with an opening therein and with cutting means on said tool at an elevated location relative to said disc-like member for causing cut pieces of food items produced by said rotary tool to pass down through said opening into the bowl, said novel cover disc comprising:

a circular disc element having a downwardly projecting peripheral flange, said peripheral flange having a predetermined inside diameter for snuggly but removably encircling said horizontal disc-like member of the rotary tool, said circular disc element having an opening therein sufficiently large to encircle said elevated cutting means plus said opening in the horizontal disc-like member, and said novel cover disc being engageable with said tool for causing said cover disc to rotate with said tool when said cover disc is mounted on said horizontal disc-like member of the tool.

14. A novel cover disc for use in the bowl of a food processor with a rotary tool as claimed in claim 13, in which:

said cover disc has a projecting lug for engaging with said tool for preventing said cover disc from turning relative to said horizontal disc-like member.

15. In a food processor of the type including a housing having an electric motor drive, a bowl mountable on said housing for enclosing a rotary food processing tool within said bowl, said tool being rotatable within said bowl by said electric motor drive, a removable cover adapted to be secured in position on said bowl, a feed tube forming a passageway for feeding food items into said bowl, said food processing tool having an elongated hub with a head on one end thereof adapted to be coupled to and rotated by said electric motor drive, and a horizontal disc-like member mounted on said hub head having an opening therethrough and cutting means positioned above said opening at an elevated location relative to said disc-like member, the thickness of the cut pieces produced by said cutting means being determined by the difference in elevation between said cutting means and the top surface of said disc-like member, the improvement comprising:

a cover disc having the same general configuration as said horizontal disc-like member with an opening in said cover disc, said cover disc being adapted to be fitted on top of said horizontal disc-like member of the rotary tool, with said opening in said cover disc being in registration with said opening in said horizontal disc-like member, positioning means on said cover disc engageable with said horizontal disc-like member when said cover disc is fitted on top of said horizontal disc-like member, said positioning means preventing said cover disc from turning relative to said horizontal disc-like member, and a plurality of auxiliary blades mounted on said cover disc extending vertically upward in front of the opening in said cover disc for being located between said cover disc and said cutting means for altering the type of cut normally provided by said cutting means on the bare food processing tool when used without said cover disc, whereby said cover disc is caused to rotate together with said tool, by virture of which the thickness of the cut pieces produced by said cutting means becomes reduced to be equal to the difference in elevation between said cutting means and the top of said disc-like cover and the type of cut pieces produced by the tool are altered by said auxiliary blades.

16. In a food processor as set forth in claim 15 wherein said cutting means comrpises a slicing blade mounted on the rim of an elevated platform on said horizontal disc-like member and said elevated platform has a gradually sloping shoulder, the improvement in which:

said opening in said cover disc conforms with the configuration of said elevated platform plus said opening and is nestled down around said gradually sloping shoulder when said cover disc is fitted on the horizontal disc-like member food processing tool and with the opening in said disc-like member being uncovered.

17. In a food processor of the type including a housing having an electric motor drive, a bowl mountable on said housing for enclosing a rotary food processing tool within said bowl, said tool being rotatable within said bowl by said electric motor drive, a removable cover adapted to be secured in position on said bowl, a feed tube forming a passageway for feeding food items into said bowl, said food processing tool having an elongated hub with a head on one end thereof and a coupling means on the other end thereof adapted to be coupled to and rotated by said electric motor drive, and a horizontal disc-like member mounted on said hub head having an opening therethrough and cutting means positioned above said opening at an elevated location relative to said disc-like member, the thickness of the cut pieces produced by said cutting means being determined by the difference in elevation between said cutting means and the top surface of said disc-like member, the improvement comprising:

a cover disc having the same general configuration as said horizontal disc-like member with an opening in said cover disc, said cover disc having a thin peripheral rim encircling said cover disc and projecting down from said cover disc, said rim having a predetermined inside diameter for snuggly but removably encircling the perimeter of said disc-like member, said cover disc being adapted to be fitted on top of said horizontal disc-like member of the rotary tool, with said opening in said cover disc being in registration with said opening in said horizontal disc-like member, positioning means on said cover disc engageable with said horizontal disc-like member when said cover disc is fitted on top of said horizontal disc-like member, and said positioning means preventing said cover disc from turning relative to said horizontal disc-like member, whereby said cover disc is caused to rotate together with said tool, by virtue of which the thickness of the cut pieces produced by said cutting means becomes reduced to be equal to the difference in elevation between said cutting means and the top of said disc-like cover,

18. In a food processor as set forth in claim 17 wherein said cutting means comprises a slicing blade mounted on the rim of an elevated platform on said horizontal disc-like member and said elevated platform has a gradually sloping shoulder, the imrpovement in which:

said opening in said cover disc conforms with the configuration of said elevated platform plus said opening and is nestled down around said gradually sloping shoulder when said cover disc is fitted on the horizontal disc-like member food processing tool and with the opening in said disc-like member being uncovered.

19. A rotary food cutting tool for use in a rotary food processor of the type having an upright working bowl for enclosing the rotary food cutting tool and motor drive means for rotating the tool within said bowl and a removable cover adapted to be secured on said bowl and a feed tube for feeding food items to said rotary cutting tool in said bowl, said novel rotary food cutting tool comprising:

an elongated hub having an upper head and a lower drive coupling portion adapted to be coupled to and rotated by said motor drive means, said upper head of said hub having a horizontal disc-like member secured thereto for rotation therewith, said disc-like member having an opening therein and an elevated cutting means positioned at an elevation above said opening in said horizontal disc-like member, a cover disc adapted to be mounted for rotation with said disc-like member, mounting means on said cover disc for removably mounting said cover disc on said disc-like member, an opening in said cover disc which generally surrounds said elevated cutting means and said opening in said disc-like member when said cover disc is mounted on said disc-like member, said cover disc having a predetermined thickness which when mounted on said disc-like member determines the thickness of the cut pieces produced by said cutting means, said thickness being the difference in elevation between said cutting means and the top surface of said cover disc when mounted on said disc-like member, whereby the thickness of cut pieces produced by said tool may be varied by changing the cover disc mounted on said disc-like member without requiring the removal and replacement of the entire tool in said bowl, and said cover disc having a plurality of auxiliary blades on the top surface thereof extending vertically upward in front of the opening in said cover disc for being located between said cover disc and said elevated cutting means for altering the cutting function of said rotary cutting tool by said auxiliary blades on said cover disc.

20. The rotary food cutting tool as claimed in claim 19 in which:

said cutting means comprises a slicing blade mounted on the rim of an elevated platform, said elevated platform having a gradually sloping rear shoulder, and said cover disc conforms with the configuration of said platform and its gradually sloping shoulder plus the opening in said disc-like member for enabling the opening in said cover disc to nestle around said platform and its shoulder with said opening in the disc-like member remaining uncovered when said cover disc is mounted on said rotary food cutting tool.

21. A rotary food cutting tool for use in a rotary food processor of the type having an upright working bowl for enclosing the rotary food cutting tool and motor drive means for rotating the tool within said bowl and a removable cover adapted to be secured on said bowl and a feed tube for feeding food items to said rotary cutting tool in said bowl, said novel rotary food cutting tool comprising:

an elongated hub having an upper head and a lower drive coupling portion adapted to be coupled to and rotated by said motor drive means, said upper head of said hub having a horizontal disc-like member secured thereto for rotation therewith, said disc-like member having an opening therein and an elevated cutting means positioned at an elevation above said opening in said horizontal disc-like member, a cover disc adapted to be mounted for rotation with said disc-like member, mounting means on said cover disc for removably mounting said cover disc on said disc-like member, an opening in said cover disc which generally surrounds said elevated cutting means and said opening in said disc-like member when said cover disc is mounted on said disc-like member, said cover disc having a predetermined thickness which when mounted on said disc-like member determines the thickness of the cut pieces produced by said cutting means, said thickness being the difference in elevation between said cutting means and the top surface of said cover disc when mounted on said disc-like member, said mounting means includes a thin, downwardly projecting rim encircling said cover disc, and said rim having a predetermined inside diameter for snuggly but removably embracing the perimeter of said disc-like member, whereby the thickness of cut pieces produced by said tool may be varied by changing the cover disc mounted on said disc-like member without requiring the removal and replacement of the entire tool in said bowl.

* * * * *